US008348404B2

(12) United States Patent
Wayman et al.

(10) Patent No.: US 8,348,404 B2
(45) Date of Patent: Jan. 8, 2013

(54) METHOD AND SYSTEM FOR MELTER TANK AIRFLOW MANAGEMENT

(75) Inventors: William H. Wayman, Ontario, NY (US); Michael J. Brundige, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 423 days.

(21) Appl. No.: 12/695,147

(22) Filed: Jan. 27, 2010

(65) Prior Publication Data

US 2011/0180526 A1 Jul. 28, 2011

(51) Int. Cl.
*B41J 2/175* (2006.01)

(52) U.S. Cl. ..... 347/88; 347/100; 219/438

(58) Field of Classification Search ..... 219/420, 219/428, 429, 449.1
See application file for complete search history.

(56) References Cited

U.S. PATENT DOCUMENTS 6,502,520 B1 * 1/2003 Nishi et al. ..... 110/237

* cited by examiner

*Primary Examiner* — Cheung Lee
(74) *Attorney, Agent, or Firm* — Joseph E. Root

(57) ABSTRACT

An airflow system for a solid-ink melter tank is disclosed, which prevents clogging of drop tube supplying solid ink to the solid-ink melter tank. An inlet may provide airflow as well as solid ink to the melter tank and an outlet maintained at a temperature higher than temperature of the inlet, promotes a convective air current. The inlet may be coaxial with the drop tube or is present as a separate opening in the solid-ink melter tank. The outlet can be taller, externally insulated, and fabricated with a thermally conductive material as compared to the inlet. The heated outlet promotes expulsion of hot air from the solid-ink melter tank and prevents heating of drop tube, which leads to drop tube clogging by partially melting the solid ink.

28 Claims, 4 Drawing Sheets

METHOD AND SYSTEM FOR MELTER TANK AIRFLOW MANAGEMENT

TECHNICAL FIELD

This application deals generally with image-producing devices, and more specifically, with solid-ink based image-producing devices.

BACKGROUND

Solid ink (also known as phase-change ink) image-producing devices conventionally employ ink supplied in solid form through a drop tube, either as pellets or as colored-ink sticks. In general, phase change inks are in solid form at ambient temperature, but the ink must be converted to liquid form and transported to the print head, where the ink can be ejected as drops or jets. Generally, this phase change is accomplished by melting the solid ink in a solid-ink melter tank. A melter assembly for large ink sticks includes a heating element with openings, which allow liquefied solid ink to pass through is disclosed in U.S. application Ser. No. 12/362,579 filed Jan. 30, 2009. Another U.S. application Ser. No. 12/638,863, filed Dec. 15, 2009, discloses a solid-ink melter apparatus including a heating element designed as an array of spaced apart fins, with a number of heat transfer elements passing through the fins. Liquefied solid ink is subsequently supplied to a print head of the image-producing device, forming jets of ink that print on the target media. When the ink droplets contact the printing media, they quickly solidify to create an image in the desired pattern.

Typically, heating elements in the solid-ink melter tank heat the air present in the solid-ink melter tank. In the absence of a forced airflow path, the hot air rises from the solid-ink melter tank into the drop tube, which heats the metering valve and the solid ink in the solid-ink supply tank. As the drop tube's temperature rises, some of the incoming solid ink partially melts and clings to the drop tube and the associated components, such as metering valves, leading to clogging of the drop tube and the associated components.

An electric cooling fan supplying cool air to the drop tube and the associated components may offer a solution to the problem. Sudden power failure, however, can cause the electric cooling fan to stop, leading to clogging of the metering valve, the solid-ink supply tank, the drop tube, and the associated components.

Therefore, a need exists for a mechanism to maintain the solid-ink drop tube and the associated components at a lower temperature.

SUMMARY

The present disclosure provides embodiments of an airflow system for a solid-ink melter tank. The airflow system includes an inlet for providing airflow into the solid-ink melter tank, and an outlet maintained at a temperature higher than the temperature of the inlet. The heated outlet promotes a convective air current; the heated air exits from the outlet and draws cool air in the inlet.

Further, an embodiment of an airflow management method for a solid-ink melter tank is disclosed. The airflow management method provides an inlet for supplying airflow to the solid-ink melter tank and an outlet maintained at a temperature higher than the temperature of the inlet for promoting a convective air current, which draws cool air into the inlet.

According to the aspects illustrated herein, an airflow system for a solid-ink melter tank is provided. The system includes a hopper for carrying the solid ink, a drop tube connected to the hopper for supplying the solid ink to the solid-ink melter tank, and a metering valve for controlling the amount of solid ink entering the solid-ink melter tank. An inlet allows air into the solid-ink melter tank and an outlet, maintained at a temperature higher than temperature of the inlet, promotes a convective air current, drawing cool air in the inlet. Multiple heating elements for melting the solid ink are disposed in the form of parallel plates within the solid-ink melter tank. Liquefied solid ink accumulates in a collection area, below the heating elements, within the solid-ink melter tank.

BRIEF DESCRIPTION OF THE DRAWINGS

The figures described below set out and illustrate a number of exemplary embodiments of the disclosure. Throughout the drawings, like reference numerals refer to identical or functionally similar elements. The drawings are illustrative in nature and are not drawn to scale.

DETAILED DESCRIPTION

The following detailed description is made with reference to the figures. Exemplary embodiments are described to illustrate the subject matter of the disclosure, not to limit its scope, which is defined by the appended claims.

As used throughout the disclosure, the term "solid-ink melter tank" refers to a container for retaining liquefied solid ink. The solid ink may either be melted by multiple heating elements present in the solid-ink melter tank or be melted elsewhere and retained in the solid-ink melter tank in liquid phase.

Overview

To prevent drop tube clogging in conventional solid-ink melter tanks, the present disclosure describes a system and method for promoting a convective air current in a solid-ink melter tank. The solid-ink melter tank includes an inlet for allowing airflow in the solid-ink melter tank, a heated outlet for promoting exit of hot air, and multiple heating elements for supplying heat for melting the solid ink. The heated outlet promotes a convective air current in the solid-ink melter tank and facilitates exit of hot air through the heated outlet and intake of cool air from the inlet. The inlet may also function as a drop tube by allowing air as well as solid ink into the solid-ink melter tank. The convective air current prevents heating of the inlet as well as the drop tube, thus preventing clogging of the inlet by partial melting of solid ink.

Description

Figure 1:
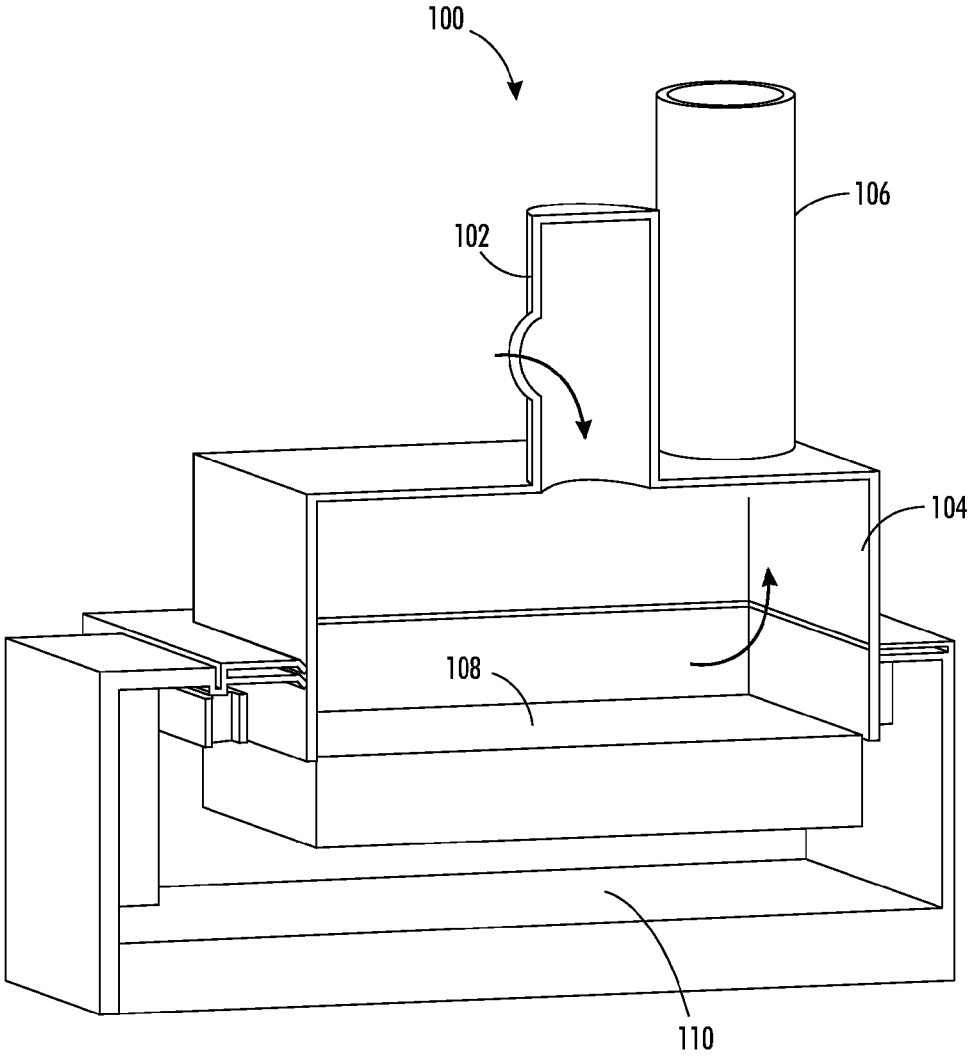
FIG. 1 depicts an exemplary embodiment of an airflow system for a solid-ink melter tank.

FIG. 1 depicts an exemplary embodiment of an airflow system 100 for a solid-ink melter tank apparatus. As depicted in FIG. 1, an inlet 102 allows airflow into a solid-ink melter tank 104 and an outlet 106, maintained at a temperature higher than temperature of the inlet 102, releases hot air, promoting a convective air current within the solid-ink melter tank 104. The inlet 102 functions as a drop tube by supplying solid ink to the solid-ink melter tank 104 in addition to airflow. The inlet 102 engages a hopper (not shown in FIG. 1), holding the solid ink, via a metering valve (not shown in FIG. 1), which controls the amount of solid ink entering the solid-ink melter tank 104. As seen in FIG. 1, multiple heating elements 108, provided in the solid-ink melter tank 104, impart heat to the solid ink, causing it to melt. In some embodiments, the heating elements 108 are present at a temperature of approximately 100° C. to approximately 200° C. at all times. Air, in contact with the heating elements 108, becomes heated and rises through the inlet 102 in the absence of a heated outlet. A collection area 110, provided below the heating elements 108, collects liquefied solid ink. The inlet 102 and the outlet 106 are present as substantially vertically oriented, substantially cylindrical pipes according to one of the embodiments. In certain embodiments, the outlet 106 is taller than the inlet 102.

Furthermore, the outlet 106 is fabricated from a material with high thermal conductivity, such as aluminum, while the inlet 102 is fabricated from a material having low thermal conductivity, such as plastic. The outlet 106 may be maintained at a temperature higher than the temperature of the inlet 102 either by thermal conduction with the solid-ink melter tank 104 or by an external electric heating element. Those of skill in the art will recognize the class of materials generally referred to as "thermally conductive" and will be able to select a suitable material from that class to fit a particular application.

In another embodiment, the airflow and the solid ink enter the solid-ink melter tank 104 through two different openings in the solid-ink melter tank 104. The inlet 102 supplies airflow and a drop tube supplies solid ink to the solid-ink melter tank 104. In an embodiment of the present disclosure, an opening in the solid-ink melter tank 104 serves as the inlet 102. The inlet 102 and the drop tube may be coaxial according to another embodiment. In further embodiments, the outer surface of the outlet 106 may be covered with an insulating material such as mineral wool to prevent heat loss to the surroundings.

Figure 2:
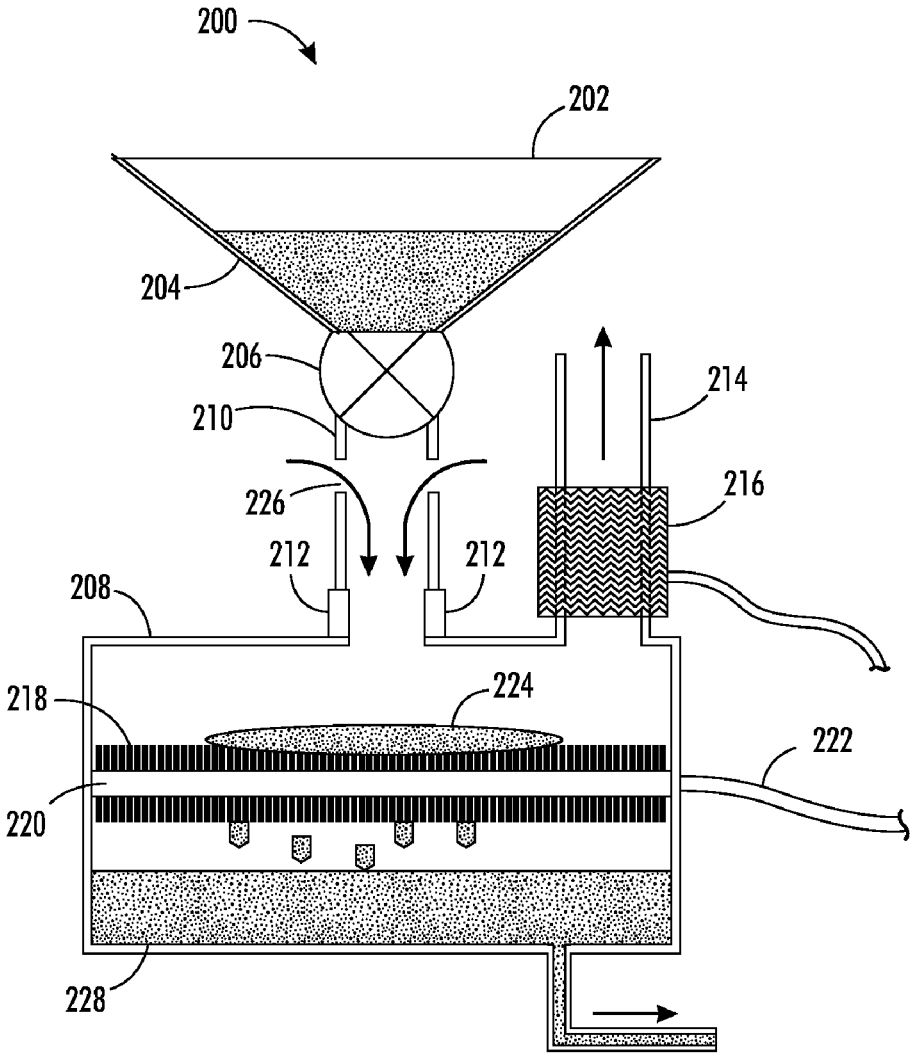
FIG. 2 illustrates an exemplary embodiment of an airflow system for a solid-ink melter tank where thermal breaks prevent conductive heating of the drop tube.

FIG. 2 illustrates an exemplary embodiment of an airflow system for a solid-ink melter tank where thermal breaks prevent conductive heating of the drop tube. The airflow system 200 includes a hopper 202 for holding solid ink 204. The hopper 202 connects to a metering valve 206, which controls the amount of solid ink 204 entering a solid-ink melter tank 208. An inlet 210 functions as a drop tube by allowing both airflow and solid ink 204 into the solid-ink melter tank 208. The inlet 210 also includes thermal breaks 212, formed of a material having substantially lower thermal conductivity than the material on either side of the thermal breaks 212. The thermal breaks 212 can be formed of low thermal conductivity materials such as ceramic, plastic, or any other material that can tolerate the temperature of the melting tank. By preventing heat flow from the relatively hot solid-ink melter tank 208 to the relatively cooler inlet 210, the thermal breaks 212 ensure that intake of cool air will be able to cool the inlet 210 functioning as a drop tube.

An outlet 214 to the solid-ink melter tank 208 is maintained at a temperature higher than temperature of inlet 210, by an electric heating element 216, leading to a convective air current. Multiple heating elements 218, placed within the solid-ink melter tank 208, heat the solid ink 204. The heating elements 218, heated by an electric heater 220, connect to a power source via a power cord 222. The solid ink 204 melts upon making contact with the multiple heating elements 218. Air, exposed to the heating elements 218, also becomes heated. The hot air exits through the heated outlet 214, leading to intake of cool air from the inlet 210 through air vents 226. Liquefied solid ink 224 drips off the bottom of the heating elements 218 to a collection area 228 below.

As shown in FIG. 2, the inlet 210 also functions as a drop tube by supplying solid ink 204 to the solid-ink melter tank 208. In another embodiment, however, the inlet 210 may be present as an element separate from the drop tube in the solid-ink melter tank 208. Alternatively, in another embodiment, the inlet 210 may be coaxial with the drop tube. In some embodiments, the inlet 210 is fabricated from a material having low thermal conductivity, for example, plastic. In certain embodiments, a thermally conductive material, such as aluminum, is utilized for fabricating the outlet 214. In further embodiments, the outer surface of the outlet 214 may be covered with an insulating material such as mineral wool to prevent heat loss to the surroundings. Further, both the inlet 210 and the outlet 214 are substantially vertically oriented, substantially cylindrical pipes according to some embodiments.

In several embodiments, the outlet 214 is taller than the inlet 210. The taller, heated outlet 214 ensures correct direction of airflow, with cool air entering the solid-ink melter tank 208 via the shorter inlet 210 and hot air leaving the solid-ink melter tank 208 via the taller outlet 214.

Figure 3:
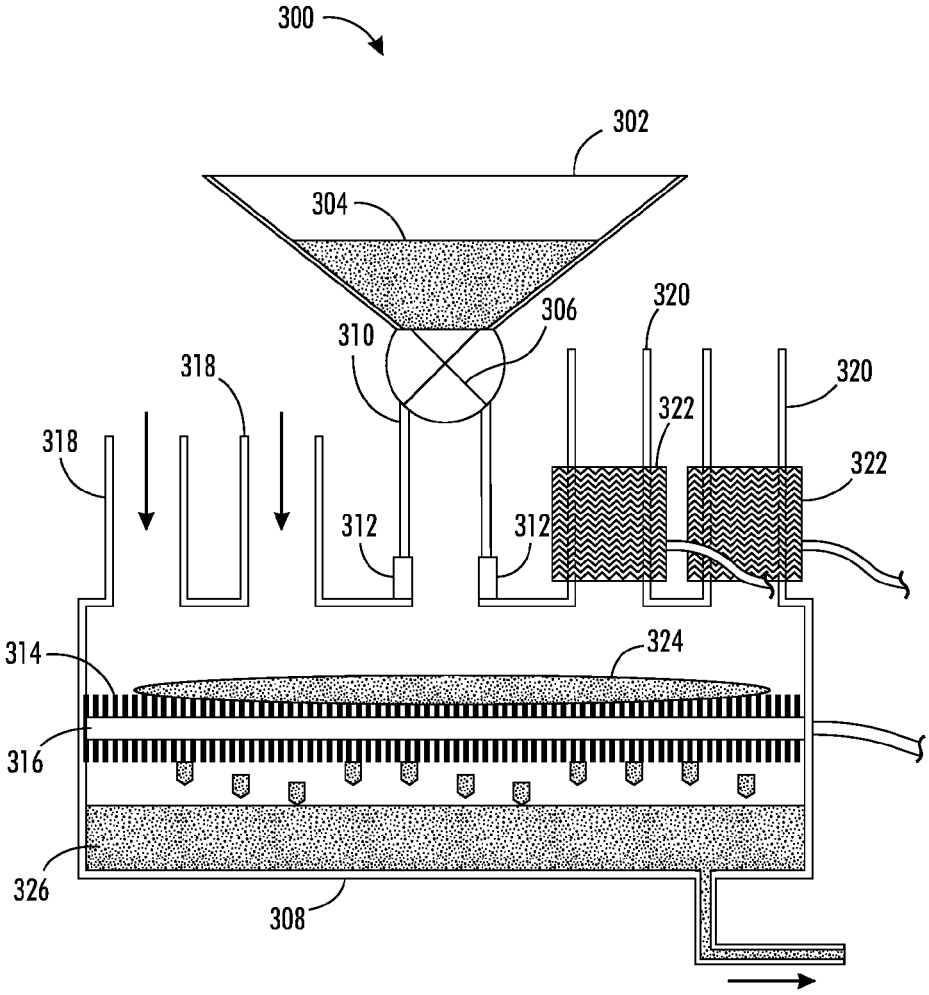
FIG. 3 depicts an alternate embodiment of an airflow system, having two inlets and two outlets.

FIG. 3 depicts an alternate embodiment of an airflow system, having two inlets and two outlets. As shown in FIG. 3, a hopper 302 holds solid ink 304 and is connected to a metering valve 306, which controls the amount of solid ink 304 entering a solid-ink melter tank 308. A drop tube 310, thermal breaks 312, multiple heating elements 314, and an electric heater 316 perform similar functions as described in relation with FIG. 2. Two inlets 318 supply airflow to the solid-ink melter tank 308. Two outlets 320 of the solid-ink melter tank 308 are maintained at a temperature higher than temperature of the inlets 318 by electric heaters 322. This structure promotes a convective air current, allowing cool air into the solid-ink melter tank 308 through the inlets 318 and facilitating hot air expulsion through the heated outlets 320. The advantage of multiple inlets or outlets is that the air flow inside the solid-ink melter tank 308 can be tailored for improved thermal uniformity, avoiding creation of hot spots on the heating elements 314. Liquefied solid ink 324 drips off the bottom of the heating elements 314 into a collection area 326. The convective air current keeps the drop tube 310 and the metering valve 306 at a lower temperature. In certain embodiments, the outlets 320 are taller than the inlets 318.

Figure 4:
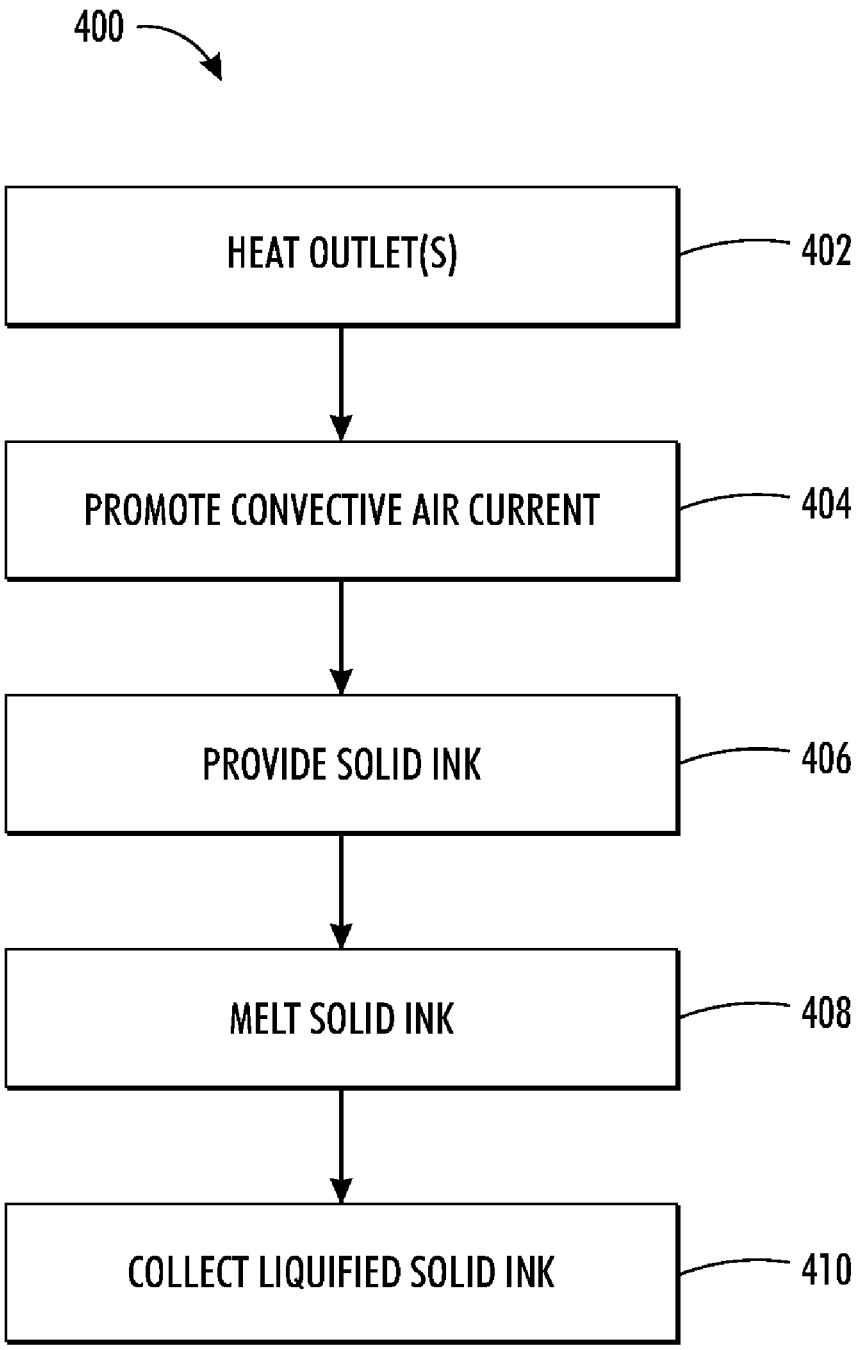
FIG. 4 is a flowchart depicting an exemplary embodiment of an airflow management method employed for melting solid ink in a solid-ink melter tank.

FIG. 4 is a flowchart depicting an exemplary embodiment of an airflow management method 400, employed for melting solid ink in a solid-ink melter tank. A drop tube supplies solid ink to the solid-ink melter tank, an inlet allows cool air into the solid-ink melter tank, and an outlet expels hot air from the solid-ink melter tank. In another embodiment, the inlet supplies both airflow as well as solid ink to the solid-ink melter tank. Further, the multiple heating elements in the solid-ink melter tank supply heat, melting the solid ink. The outlet is heated to a temperature higher than the temperature of the inlet, at step 402. The inlet and the heated outlet promote a convective air current at step 404, drawing cool air from the inlet and expelling hot air from the heated outlet. In the absence of the heated outlet, hot air from the solid-ink melter tank rises through the drop tube, raising its temperature in the process. The heated drop tube partially melts the incoming solid ink, which sticks to the walls of the drop tube, leading to clogging. In the present embodiment, however, incorporating the heated outlet prevents the clogging of the inlet. At step 406, the drop tube provides solid ink to the solid-ink melter tank. The heating elements, within the melter tank, heat and melt the solid ink at step 408. As depicted in FIG. 4, liquefied solid ink accumulates in an area below the heating elements at step 410.

In certain embodiments, the outlet may be taller than the inlet. Also, in some embodiments, heat loss to the surroundings is lowered by insulating the outer surface of the outlet with an insulating material such as mineral wool. In one implementation, the outlet fabrication material has a high thermal conductivity while the inlet fabrication material has a low thermal conductivity. In another implementation, the outlet and the inlet are cylindrical pipes. In some embodiments, more than one inlet and outlet of the solid-ink melter tank may be present.

Those skilled in the art will understand that the steps set out in the discussion above may be combined or altered in specific adaptations of the disclosure. The illustrated steps are set out to explain the embodiment shown, and it should be anticipated that ongoing technological development will change the manner in which particular functions are performed. These depictions do not limit the scope of this disclosure, which is determined solely by reference to the appended claims.

Moreover, the solid-ink melter tank 104 shown in FIG. 1 employs direct-heating techniques as the heating elements 108 are in direct contact with the solid-ink melter tank 104. Alternatively, convection heating technologies may be employed for melting the solid ink.

CONCLUSION

The specification has described an airflow system for a solid-ink melter tank utilized for melting solid ink. The specification has set out a number of specific exemplary embodiments, but persons of skill in the art will understand that variations in these embodiments will naturally occur in the course of embodying the subject matter of the disclosure in specific implementations and environments. For example, the inlet supplying airflow and the drop tube allowing solid ink in the solid-ink melter tank may be coaxial with each other or be present as separate openings in the solid-ink melter tank. Furthermore, the heating elements utilized for melting the solid ink may be present as a grid. A first set of heating elements is formed of parallel plates placed one millimeter apart from each other. The first set of heating elements is placed perpendicular to a similarly constructed second set of heating elements, resulting in the grid. It will further be understood that such variations and others as well, fall within the scope of the disclosure. Neither those possible variations nor the specific examples set above are set out to limit the scope of the disclosure. Rather, the scope of disclosure is defined solely by the claims set out below.

Systems and methods disclosed herein may be implemented in equipment employing other granular materials, such as resin, alloys, paraffin wax, soap, gels, oil, or plastics. Apparatus of the disclosure can be implemented in image-producing devices employing solid ink, to prevent clogging of inlet 102 supplying airflow as well as solid ink into the solid-ink melter tank 104. Method steps of the disclosure can be performed by utilizing heated outlets 106 for promoting a convective air current in the solid-ink melter tank 104. Multiple heating elements 108 provide heat to melt the solid ink, which drips off the bottom of heating elements 108 to accumulate in a collection area 110, for further supply to the print head. The convective air current prevents clogging by drawing cool air through the inlet 102. Any of the foregoing may be incorporated in solid ink printers, copiers, scanners, fax machines or in a combination of them.

We claim:

1. An airflow system for a solid-ink melter tank, the system comprising:

a structure defining an inlet configured to provide airflow into the melter tank; and a structure defining an outlet maintained at a temperature higher than the temperature of the structure defining the inlet, the heated structure defining the outlet promoting a convective air current, drawing cool air into the inlet.

2. The airflow system of claim 1, wherein the structure defining the inlet is further configured to admit the solid ink to the melter tank.

3. The airflow system of claim 1, wherein a drop tube is configured to supply solid ink to the melter tank.

4. The airflow system of claim 3 further comprising the drop tube substantially coaxially mounted with the inlet.

5. The airflow system of claim 1, wherein the structure defining the outlet is effectively disposed higher than the inlet.

6. The airflow system of claim 1, wherein the inlet includes a substantially vertically oriented, substantially cylindrical pipe.

7. The airflow system of claim 1, wherein the outlet includes a substantially vertically oriented, substantially cylindrical pipe.

8. The airflow system of claim 1 further comprising a heating element configured to heat the outlet.

9. The airflow system of claim 1, wherein the structure defining the outlet is configured to be heated by thermal conduction with the melter tank.

10. The airflow system of claim 1, wherein the structure defining the outlet is insulated.

11. The airflow system of claim 1, wherein the inlet includes a thermal break, reducing thermal conduction to the melter tank.

12. The airflow system of claim 1, wherein the structure defining the inlet possesses low thermal conductivity compared to the structure defining the outlet.

13. The airflow system of claim 1, wherein the structure defining the inlet substantially comprises plastic.

14. The airflow system of claim 1, wherein the structure defining the outlet is substantially thermally conductive.

15. The airflow system of claim 1, wherein the structure defining the outlet substantially comprises aluminum.

16. The airflow system of claim 1 further comprising one or more heating elements within the melter tank, the one or more heating elements being configured to provide heat for melting the solid ink.

17. The airflow system of claim 16 further comprising a collection area below the one or more heating elements, the collection area being configured to collect the liquefied solid ink.

18. An airflow system for a melter tank, the system comprising:

a structure defining an inlet configured to allow airflow into the melter tank, the inlet admitting solid ink to the melter tank; and a structure defining an outlet maintained at a temperature higher than the temperature of the structure defining the inlet, the heated structure defining the outlet promoting a convective air current, drawing cool air into the inlet and the structure defining the outlet being fabricated from a material with higher thermal conductivity than the structure defining the inlet.

19. An airflow management method for a solid-ink melter tank, the method comprising:

providing a drop tube, supplying solid ink to the melter tank;

providing an inlet to the melter tank;

providing an outlet to the melter tank; and heating the outlet to a temperature higher than the temperature of the inlet, promoting a convective air current, drawing cool air into the inlet.

20. The method of claim 19 further comprising admitting the solid ink to the melter tank through the inlet.

21. The method of claim 19, wherein the outlet is taller than the inlet.

22. The method of claim 19 further comprising insulating the outlet on the outside.

23. The method of claim 19 further comprising constructing the inlet from a material with low thermal conductivity.

24. The method of claim 19 further comprising constructing the outlet from a material with high thermal conductivity.

25. The method of claim 19 further comprising heating the solid ink by one or more heating elements present within the melter tank.

26. The method of claim 25 further comprising maintaining the one or more heating elements at a temperature ranging from approximately 100° C. to approximately 200° C.

27. The method of claim 25 further comprising collecting the liquefied solid ink in a collection area below the one or more heating elements.

28. A method for melting solid ink in a melter tank, the method comprising:

providing an inlet to the melter tank;

supplying the solid ink to the melter tank through a drop tube;

providing an outlet to the melter tank;

heating the outlet to a temperature higher than the temperature of the inlet, promoting a convective air current, drawing cool air into the inlet;

melting the solid ink in the melter tank, utilizing one or more heating elements disposed within the melter tank; and collecting the liquefied solid ink in a collection area below the one or more heating elements.

* * * * *